US012096837B2

(12) United States Patent
Kim

(10) Patent No.: US 12,096,837 B2
(45) Date of Patent: Sep. 24, 2024

(54) COSMETIC CONTAINER

(71) Applicant: LG HOUSEHOLD & HEALTH CARE LTD., Seoul (KR)

(72) Inventor: Sung Tae Kim, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 115 days.

(21) Appl. No.: 17/799,853

(22) PCT Filed: Jan. 11, 2021

(86) PCT No.: PCT/KR2021/000311
§ 371 (c)(1),
(2) Date: Aug. 15, 2022

(87) PCT Pub. No.: WO2021/235644
PCT Pub. Date: Nov. 25, 2021

(65) Prior Publication Data

US 2023/0085820 A1 Mar. 23, 2023

(30) Foreign Application Priority Data

May 21, 2020 (KR) ..... 10-2020-0061219

(51) Int. Cl.
*A45D 40/06* (2006.01)
*A45D 40/12* (2006.01)
*A45D 40/00* (2006.01)

(52) U.S. Cl.
CPC ..... *A45D 40/065* (2013.01); *A45D 40/12* (2013.01); *A45D 2040/0025* (2013.01)

(58) Field of Classification Search
CPC ..... A45D 40/06; A45D 40/065; A45D 40/12; A45D 40/02; A45D 2040/0025
See application file for complete search history.

(56) References Cited

U.S. PATENT DOCUMENTS 2,840,229 A * 6/1958 Hopgood ..... A45D 40/06 215/346
3,515,493 A * 6/1970 Gruska ..... A45D 40/06 401/74

(Continued)

FOREIGN PATENT DOCUMENTS

CN 1271962 C 8/2006
CN 206852275 U 1/2018

(Continued)

*Primary Examiner* — Javier A Pagan
(74) *Attorney, Agent, or Firm* — Birch, Stewart, Kolasch & Birch, LLP

(57) ABSTRACT

The present invention relates to a cosmetic container comprising: a lifting and lowering part which receives a cosmetic and has a guide protrusion disposed on the outside thereof; a guard ring which has a spiral groove coupled to the guide protrusion and formed on the inner circumferential surface thereof; and a frame which includes a body coupled to the inner side of the guard ring and having a guide hole through which the guide protrusion of the lifting and lowering part extends, a lower edge disposed in the lower (Continued)

portion of the body, and a flange plate disposed between the body and the lower edge to allow a lower end of the guard ring to be seated thereon, wherein the cosmetic container further comprises a plurality of anti-rolling members which are arranged in an area in which the flange plate is formed so as to support the lower end of the guard ring such that shaking of the guard ring is prevented when the guard ring is rotated by rotation of the frame in order to lift and lower the lifting and lowering part.

9 Claims, 10 Drawing Sheets

(56) References Cited

U.S. PATENT DOCUMENTS

| | | | | | |
|---|---|---|---|---|---|
| 4,812,066 | A * | 3/1989 | Gueret | A45D 40/06 401/86 |
| 5,096,318 | A * | 3/1992 | Susini | A45D 40/06 401/78 |
| 5,842,803 | A * | 12/1998 | Furnell | A45D 40/12 401/78 |
| 6,109,808 | A | 8/2000 | Susini et al. | |
| 6,312,179 | B1 * | 11/2001 | Gueret | A45D 40/06 401/78 |
| 2006/0056902 | A1 * | 3/2006 | Susini | A45D 40/06 401/78 |
| 2007/0059088 | A1 * | 3/2007 | Chan | A45D 40/06 401/75 |

FOREIGN PATENT DOCUMENTS

| | | | |
|---|---|---|---|
| CN | 208573182 | U | 3/2019 |
| CN | 109892798 | A | 6/2019 |
| CN | 110876525 | A | 3/2020 |
| JP | 2006-239277 | A | 9/2006 |
| JP | 4613502 | B2 | 1/2011 |
| JP | 4937574 | B2 | 5/2012 |
| KR | 20-0402646 | Y1 | 12/2005 |
| KR | 10-1092236 | B1 | 12/2011 |
| KR | 20-2011-0011868 | U | 12/2011 |
| KR | 20-2013-0006615 | U | 11/2013 |
| KR | 20-0470899 | Y1 | 1/2014 |
| KR | 10-2017-0026867 | A | 3/2017 |
| KR | 10-2017-0059309 | A | 5/2017 |
| KR | 10-2018-0096427 | A | 8/2018 |
| KR | 10-2057260 | B1 | 12/2019 |
| KR | 20-2020-0000957 | U | 5/2020 |
| TW | 201338725 | A | 10/2013 |
| TW | M546728 | U | 8/2017 |

* cited by examiner

COSMETIC CONTAINER

CROSS REFERENCE TO RELATED APPLICATIONS

This application is the National Phase of PCT International Application No. PCT/KR2021/000311, filed on Jan. 11, 2021, which claims priority under 35 U.S.C. 119(a) to Patent Application No. 10-2020-0061219, filed in the Republic of Korea on May 21, 2020, all of which are hereby expressly incorporated by reference into the present application.

TECHNICAL FIELD

The present disclosure relates to a cosmetic container, and more particularly, to a cosmetic container including a structure for improving sensitivity of lifting and lowering.

BACKGROUND ART

In general, people have a desire to make themselves beautiful through makeup. Therefore, people feel satisfaction by making up their skin, hair, nails, lips, etc. in various ways.

In particular, in the case of lips, makeup with red color is widely used to make the lips stand out from the face, and at this time, people use lipstick, lip gloss, lip balm, lip tint, etc to makeup lips. At this time, lipstick has the effect of preventing the lips from becoming dry and cracked while making the lips look beautiful by applying color to the lips.

These lipsticks are basically made in a barrel shape, and include a cosmetic container including an a lifting and lowering part configured to accommodate a cosmetic and have a protrusion on an outer circumferential surface, a frame configured to be coupled to the outside of the lifting and lowering part and have a guide hole to which the protrusion passes through, and a guard ring configured to be coupled to the outside of the frame and have a spiral groove on an inner circumferential surface where the protrusion passing through the guide hole is located.

The stick-type cosmetic container constructed in this way is used by allowing the cosmetic to come out of the container by turning the handle of the frame to lifting and lowering the lifting and lowering part, and recently, its utilization is further increasing as it is designed to be used for other cosmetics such as eyeshadow, blusher, concealer, and stick-type sunblock in addition to lipstick.

However, a conventional stick-type cosmetic container had a high defect rate because it was difficult to maintain an appropriate clearance (tolerance) between a lower end of the guard ring and a flange plate of the frame seating the guard ring.

In other words, if the clearance between the lower end of the guard ring and the flange plate is wide, the frame rotates smoothly. However, since the guard ring and the lifting and lowering part shake and the lifting and lowering part becomes unstable, and it is not stably fixed during makeup. As a result, users cannot wear delicate makeup, users' mood is uncomfortable due to generation of fine noise, or even the cosmetic accommodated in the lifting and lowering part is broken.

On the contrary, when the clearance between the lower end of the guard ring and the flange plate is narrow, interference occurs between the lower end of the guard ring and the flange plate according to the deviation of molding size, resulting in a problem in which sensitivity of lifting and lowering decreases.

Therefore, it is necessary to make the clearance (tolerance) between the lower end of the guard ring and the flange plate neither too wide nor too narrow. Since it is difficult to have a consistent appropriate clearance due to the deviation of injection molding due to the characteristics to be made by injection molding, research to solve the above problem is being conducted.

DISCLOSURE OF THE INVENTION

[Technical Goals]

The present disclosure has been made in an effort to solve the issues of the prior art as described above. Embodiments provide a cosmetic container capable of providing stable lifting and lowering quality and minimizing shaking during lifting and lowering of a cosmetic by using an anti-rolling member capable of absorbing injection molding deviation while zeroing the clearance between a lower end of a guard ring and a flange plate.

Technical Solutions

According to an aspect of the present disclosure, there is provided a cosmetic container including a lifting and lowering part configured to accommodate a cosmetic and having a guide protrusion disposed on an outside thereof, a guard ring having a spiral groove which is coupled to the guide protrusion and formed on an inner circumferential surface thereof, and a frame including a body coupled to an inside of the guard ring and in which a guide hole through which the guide protrusion of the lifting and lowering part passes is formed, a lower edge provided in a lower portion of the body, and a flange plate provided between the body and the lower edge to allow a lower end of the guard ring to be seated thereon, wherein the cosmetic container further includes a plurality of anti-rolling members provided in an area where the flange plate is formed so as to support the lower end of the guard ring to prevent shaking of the guard ring when the guard ring is rotated by rotation of the frame in order to lift and lower the lifting and lowering part.

Specifically, the plurality of anti-rolling members may include through holes formed in a portion of the flange plate at regular intervals and through which an inside and an outside of the frame pass, upper surfaces of the through holes lying on the same line as an upper surface of the flange plate, a buffer platform formed inside the through hole and having elastic force by external force, an upper surface of the buffer platform being fixed to a lower surface of the body, and a contact part formed in a curved shape on an upper surface of the buffer platform and protruding by a predetermined height from the upper surface of the flange plate so as to contact with the lower end of the guard ring.

Specifically, the plurality of anti-rolling members may include through holes formed in a portion of the flange plate at regular intervals and through which an inside and an outside of the frame pass, upper surfaces of the through holes lying on the same line as an upper surface of the flange plate, and a buffer protrusion formed in the form of a cylindrical protrusion inside the through hole, a portion of which is fixed to a lower surface of the body, wherein the buffer protrusion protrudes from the upper surface of the flange plate by a predetermined height so that a part of the buffer protrusion protruding outward is in contact with the lower end of the guard ring and has elastic force.

Specifically, the plurality of anti-rolling members may include wrinkle protrusions formed on an upper surface of the flange plate to point-contact with the lower end of the guard ring.

Specifically, the plurality of anti-rolling members may include buffer bridges formed to, in a state where portions of the flange plate are cut at regular intervals, connect the flange plate of the cut out portions and formed thinner than a thickness of the flange plate so as to have elastic force by external force, upper surfaces of the buffer bridges lying on the same line as an upper surface of the flange plate, and a contact part formed in a curved shape on an upper surface of the buffer bridge and protruding by a predetermined height from the upper surface of the flange plate so as to contact with the lower end of the guard ring.

Specifically, the flange plate may be a deformed flange plate formed in the form of a thin film to have elastic force by external force, and the plurality of anti-rolling members may include a contact part formed in a curved shape on an upper surface of the deformed flange plate and protruding by a predetermined height from the upper surface of the flange plate so as to contact with the lower end of the guard ring.

Specifically, the plurality of anti-rolling members may include cutting grooves formed by cutting portions of the flange plate at regular intervals, and a buffer protrusion formed inside the cutting groove, wherein a part of the buffer protrusion having a predetermined height from an upper surface of the flange plate is fixed to a lower side surface of the body and protrudes outward so as to be in contact with the lower end of the guard ring, a part of the buffer protrusion located in the cutting groove extends directly downward, a part of the buffer protrusion in contact with the lower end of the guard ring is a rectangle, and the buffer protrusion has elastic force.

Specifically, the flange plate may be omitted in the frame, the lower edge is formed to extend to an area of the omitted flange plate, and the plurality of anti-rolling members may include through holes formed in portions of the extended lower edge at regular intervals through with an inside and an outside of the frame pass, upper surfaces of the through holes lying on the same line as an upper surface of the extended lower edge, and a buffer bar formed in a '⊓' shape inside the through hole, wherein a part of the buffer bar protruding outward is formed higher than the upper surface of the extended lower edge so as to be in contact with the lower end of the guard ring and the buffer bar has elastic force.

Specifically, the buffer bar may include a fixing bar extending inward from an outside of one side surface of the through hole and fixed to one side surface of the through hole so as to have a predetermined inclination upward, and a flexible bar connected to one side of the fixing bar and extending outward with a predetermined inclination upward from an inside of the through hole, wherein an end of the flexible bar protrudes outward from an outer peripheral surface of the extended lower edge and extends higher than an upper surface of the extended lower edge so as to be in contact with the lower end of the guard ring, and the flexible bar has elastic force.

Advantageous Effects

According to a cosmetic container in accordance with an embodiment of the present disclosure, it is possible to stably seat a guard ring without shaking and improve the sensitivity of lifting and lowering caused by interference by using an anti-rolling member capable of absorbing injection molding deviation while zeroing the clearance between a lower end of the guard ring and a flange plate, so that the lower end of the guard ring has a predetermined clearance with the flange plate while being in contact with the anti-rolling member having a small contact area.

BEST MODE FOR CARRYING OUT THE INVENTION

Figure 1:
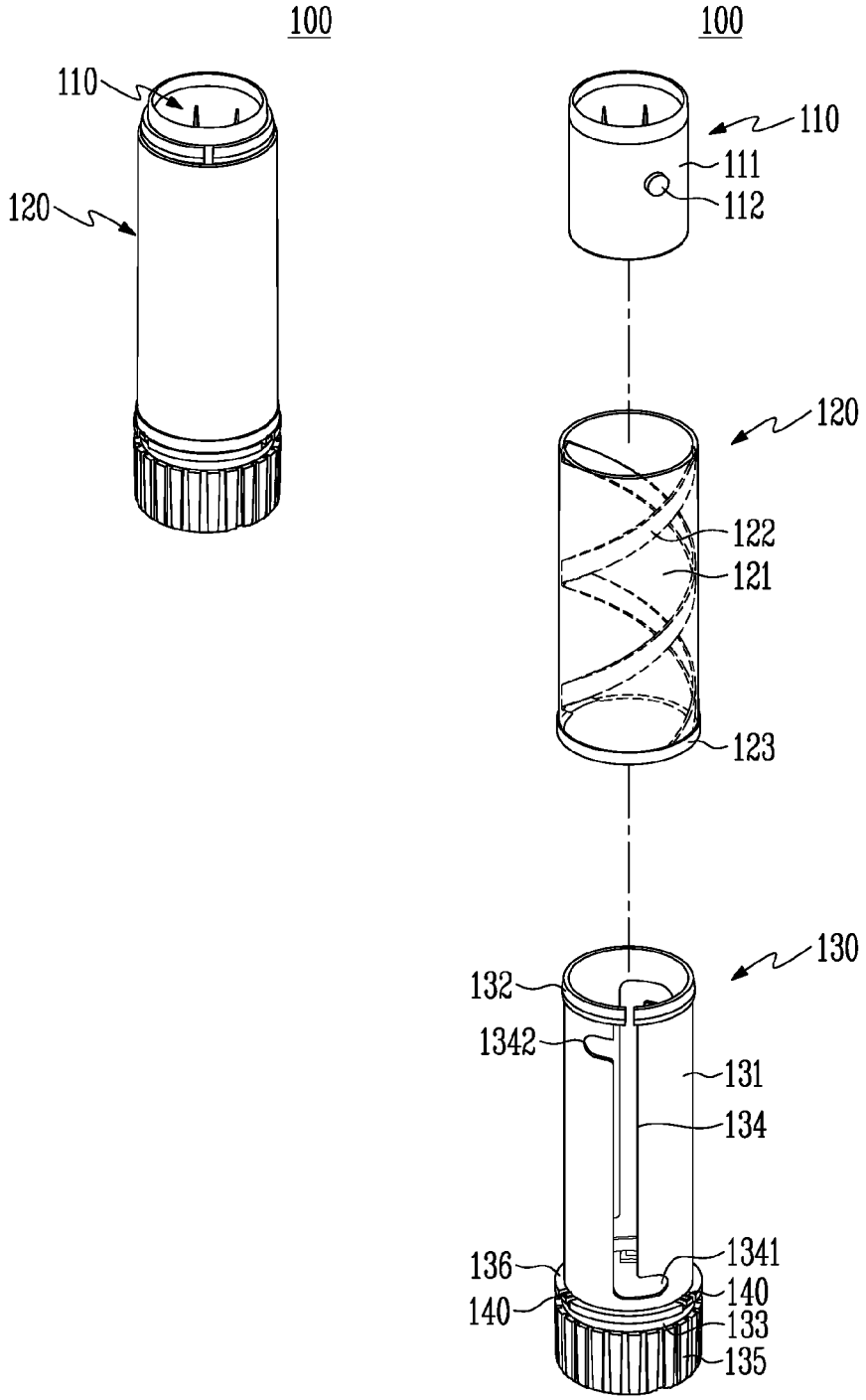
FIG. 1 is an exploded perspective view illustrating a cosmetic container in accordance with an embodiment of the present disclosure.

The objects, specific advantages, and novel features of the present disclosure will become more apparent from the following detailed description and preferred embodiments. It should be noted that, in the present specification, the reference numerals are given to the elements of the drawings, and the same elements are assigned the same number as much as possible even if they are displayed on different drawings. In addition, in describing the present disclosure, if it is determined that a detailed description of a related known technology may unnecessarily obscure the gist of the present disclosure, a detailed description thereof will be omitted.

Hereinafter, preferred embodiments of the present disclosure will be described in detail with reference to the accompanying drawings.

FIG. 1 is an exploded perspective view illustrating a cosmetic container in accordance with an embodiment of the present disclosure.

As shown in FIG. 1, a cosmetic container 100 according to an embodiment of the present disclosure includes a lifting and lowering part 110, a guard ring 120, a frame 130, and an anti-rolling member 140.

The lifting and lowering part 110 may be configured in a shape of a storing groove for accommodating a cosmetic. The cosmetic may be a lip product such as a lipstick, a lip gloss, a lip balm, and a lip tint, but is not limited thereto, and may include solid eye shadow, blush, concealer, and the like.

The lifting and lowering part 110 in a shape of a storing groove may include a plate on which the cosmetic is placed, a body 111 including a side wall extending along the circumference of the plate, and a plurality of guide protrusions 112 formed on the outer circumferential surface of the body 111. Here, a fixing protrusion (not indicated by reference numeral) for firmly fixing a solid cosmetic may be provided on an inner circumferential surface of the side wall of the body 111, and the fixing protrusion may implement a hook function that prevents the solid cosmetic from easily falling out of the lifting and lowering part 110 while having a shape allowing the solid cosmetic to be easily drawn into inside the lifting and lowering part 110.

The lifting and lowering part 110 may be provided to be lifted and lowered by screw movement in the cosmetic container 100. As the lifting and lowering part 110 is lifted and lowered, the cosmetic stored in the lifting and lowering part 110 may be exposed to the outside of the cosmetic container 100 or inserted into the cosmetic container 100. For this, the guard ring 120 and the frame 130 may be coupled to the outside of the lifting and lowering part 110.

The guard ring 120 is coupled to the outside of the frame 130. The guard ring 120 may be coupled to be seated on a flange plate 136 provided on a connector of a handle 135 of the frame 130. Accordingly, the handle 135 of the frame 130 is exposed to the outside of the guard ring 120.

A plurality of spiral grooves 122 are formed on the inner circumferential surface of the body 121 of the guard ring 120. The plurality of guide protrusions 112 formed in the lifting and lowering part 110 protruding pass through a guide hole 134 of the frame 130 are in the plurality of spiral grooves 122. The plurality of spiral grooves 122 may be formed at regular intervals, and may be intersected in at least one area.

The inclination value of the spiral groove 122 provided in the guard ring 120 may be implemented in various ways. For example, the inclination of the spiral groove 122 and the guide hole 134 may be sufficiently secured so that the lifting and lowering part 110 does not easily fall apart, thereby having an angle of 90 degrees or close to 90 degrees with the inclination value of the guide hole 134 provided in the frame 130. In this case, the lifting and lowering speed of the lifting and lowering part 110 may be get slower. On the contrary, when the angle of the inclination value is reduced, the lifting and lowering speed of the lifting and lowering part 110 may be get faster.

When the frame 130 is rotated by the rotation of the handle 135, the guide protrusion 112 passing through the guide hole 134 of the frame 130 moves up and down along the guide hole 134 of the frame 130 while moving along the spiral groove 122.

Figure 10:
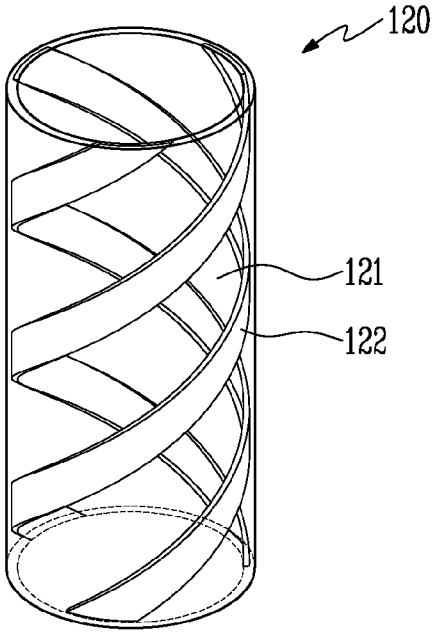
FIG. 10 is a diagram illustrating another embodiment of a guard ring of FIG. 1.

The above-described guard ring 120 is provided with a step shaped end ring 123 at the lower end seated on the flange plate 136 of the frame 130, and as shown in FIG. 10, the guard ring 120 may be formed only with the body 121 without and end ring 123.

The frame 130 is coupled to the inside of the guard ring 120 and has a tube shaped body 131 so that the lifting and lowering part 110 can be inserted, and the body 131 has a plurality of guide holes 134 to which the plurality of guide protrusions 112 formed in the lifting and lowering part 110 respectively pass through.

An upper edge 132 may be provided on the upper portion of the tube shaped body 131, and a lower edge 133 may be provided on the lower portion. The upper edge 132 and the lower edge 133 may have an outer diameter bigger than the outer diameter of the body 131 to be formed in a step shape.

The ring shaped flange plate 136 protruding outward and can seat the lower end of the guard ring 120 may be provided between the body 131 and the lower edge 133. The flange plate 136 protruding outward has a predetermined thickness. In the area where the flange plate 136 is formed, a plurality of anti-rolling members 140 to be described later may be provided.

The guide hole 134 may be formed in the body 131, and may be formed in a straight line shape or a shape having a predetermined inclination in the longitudinal direction of the frame 130, or a spiral shape having a predetermined inclination value along the circumference of the frame 130. In this case, the plurality of guide holes 134 may be provided in a shape that does not cross each other.

At least one of a lower fixing part 1341 and an upper fixing part 1342 may be formed in the guide hole 134. In this embodiment, it is illustrated that both the lower fixing part 1341 and the upper fixing part 1342 are formed in the guide hole 134, but any one of the lower fixing part 1341 and the upper fixing part 1342 may be omitted. The lower fixing part 1341 and the upper fixing part 1342 limit the movement range when the guide protrusion 112 of the lifting and lowering part 110 passes through the guide hole 134 and is lifted and lowered. Specifically, when the guide protrusion 112 of the lifting and lowering part 110 is located in the lower fixing part 1341, the guide protrusion 112 becomes in a state in which it cannot move in the vertical direction of the guide hole 134, and maintains the state in which the cosmetic coupled to the lifting and lowering part 110 is inserted inside the frame 130.

When the guide protrusion 112 of the lifting and lowering part 110 is located in the upper fixing part 1342, the guide protrusion 112 becomes in a state in which it cannot move in the vertical direction of the guide hole 134, and maintains the state in which the cosmetic coupled to the lifting and lowering part 110 is exposed to the outside the frame 130.

The handle 135 may be provided at one end of the frame 130. The handle 135 may be cast to extend from one end of the frame 130 or provided in such a way that it is fastened to the lower edge 133 forming one end of the frame 130. The handle 135 is exposed to the outside of the guard ring 120 coupled to the outside of the frame 130, provided to be rotatable with respect to the guard ring 120, so that users may rotate the handle 135 and the frame 130 connected to the handle 135 while gripping the guard ring 120.

As described above, the cosmetic container 100 includes the lifting and lowering part 110, the guard ring 120, and the frame 130, and each of these components may be manufactured by injection molding method.

In the cosmetic container 100, the lifting and lowering part 110 is lifted and lowered while the guard ring 120 is rotated by the rotation of the frame 130. At this time, the clearance (tolerance) between the frame 130 and the guard ring 120 may affect the quality of the cosmetic container 100 depending on whether it is wide or narrow.

In other words, if the clearance between the lower end of the guard ring 120 and the flange plate 136 is wide, the frame 130 rotates smoothly. However, since the guard ring 120 and the lifting and lowering part 110 shake and the lifting and lowering part becomes unstable, and it may not be stably fixed during makeup.

On the contrary, when the clearance between the lower end of the guard ring 120 and the flange plate 136 is narrow, interference occurs between the lower end of the guard ring 120 and the flange plate 136 according to the deviation of molding size, accordingly the sensitivity of lifting and lowering may decreases.

Accordingly, the cosmetic container 100 of the present embodiment may be provided with a plurality of the anti-rolling members 140 in the area where the flange plate 136 is formed to absorb the injection molding deviation while zeroing the clearance (tolerance) between the lower end of the guard ring 120 and the flange plate 136 so as to support the lower end of the guard ring 120, and the portion in contact with the lower end of the guard ring 120 becomes higher than the area where the flange plate 136 is formed as much as the injection molding deviation value, thereby preventing the guard ring 120 from shaking when the lifting and lowering part 110 is lifted and lowered. The anti-rolling member 140 may be formed in various ways, and will be described in detail below with reference to FIG. 2 to FIG. 9.

Figure 2:
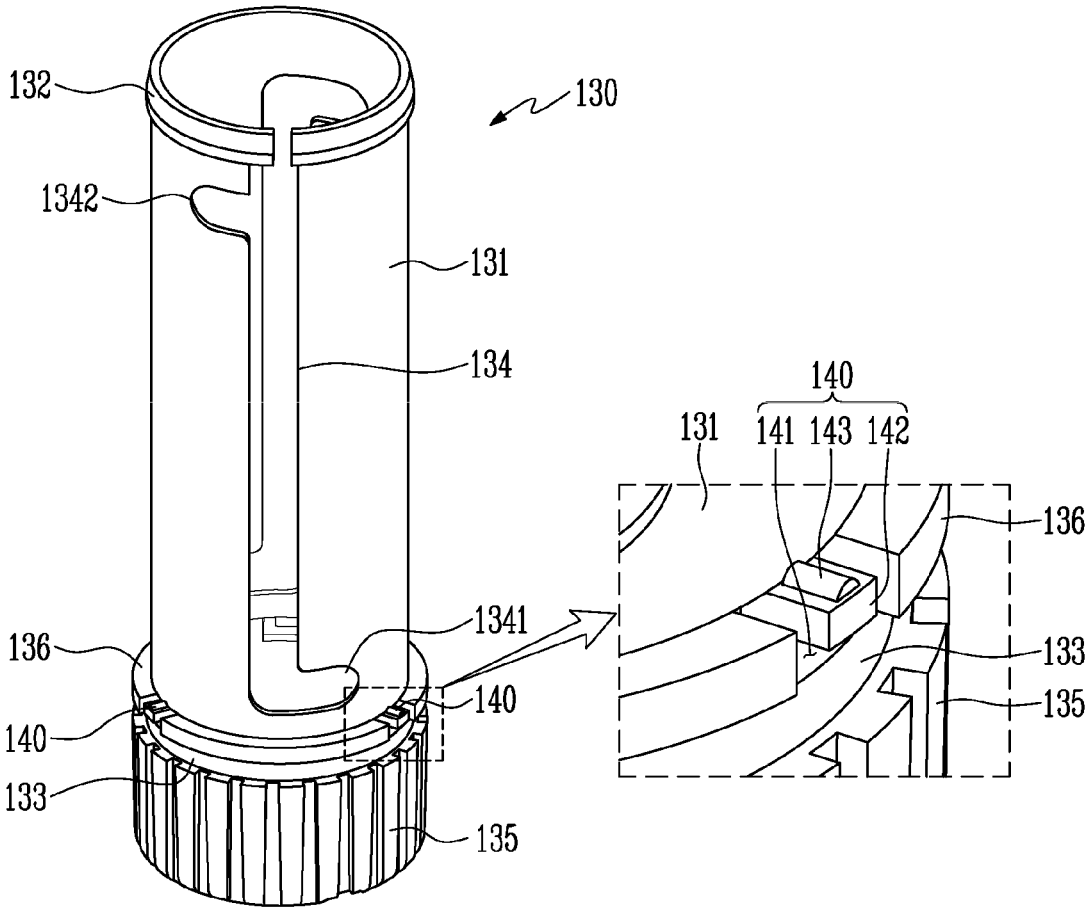
FIG. 2 is a diagram illustrating a first embodiment of an anti-rolling member of FIG. 1.

FIG. 2 is a diagram illustrating a first embodiment of the anti-rolling member 140 of FIG. 1.

In the present embodiment, a plurality of the anti-rolling members 140 may be formed in the area where the ring shaped flange plate 136 provided between the body 131 and the lower edge 133 of the frame 130 is formed, and may include a through hole 141, a buffer platform 142, and a contact part 143.

A plurality of the through holes 141 may be formed in a portion of the ring shaped flange plate 136 at regular intervals so that the inside and outside of the frame 130 pass through. The through hole 141 may be formed in a size that the buffer platform 142 may be accommodated, and the upper surface may be formed to be on the same line as the upper surface of the flange plate 136. The upper surface of the through hole 141 may be the lower end of the body 131 of the frame 130.

The buffer platform 142 may be formed inside the through hole 141. The buffer platform 142 may have elastic force by an external force, and may be a thin hexahedron. The upper surface may be fixed to a lower surface of the body 131 of the frame 130.

The contact part 143 may be formed on the upper surface of the buffer platform 142. The contact part 143 is a member in contact with the lower end of the guard ring 120, it may be formed to protrude by a predetermined height from the upper surface of the flange plate 136, and may preferably have a height corresponding to the injection molding deviation value. The contact part 143 may have a curved shape to minimize a surface contact portion with the lower end of the guard ring 120 when the frame 130 is rotated.

The anti-rolling member 140 of the present embodiment configured as described above may absorb the injection molding deviation while zeroing the clearance (tolerance) between the lower end of the guard ring 120 and the flange plate 136 by the contact part 143 in contact with the lower end of the guard ring 120 and the buffer platform 142 having elastic force by external force transmitted by the contact part 143, thereby preventing the guard ring 120 from shaking when rotating the frame 130 for lifting and lowering of the lifting and lowering part 110.

Figure 3:
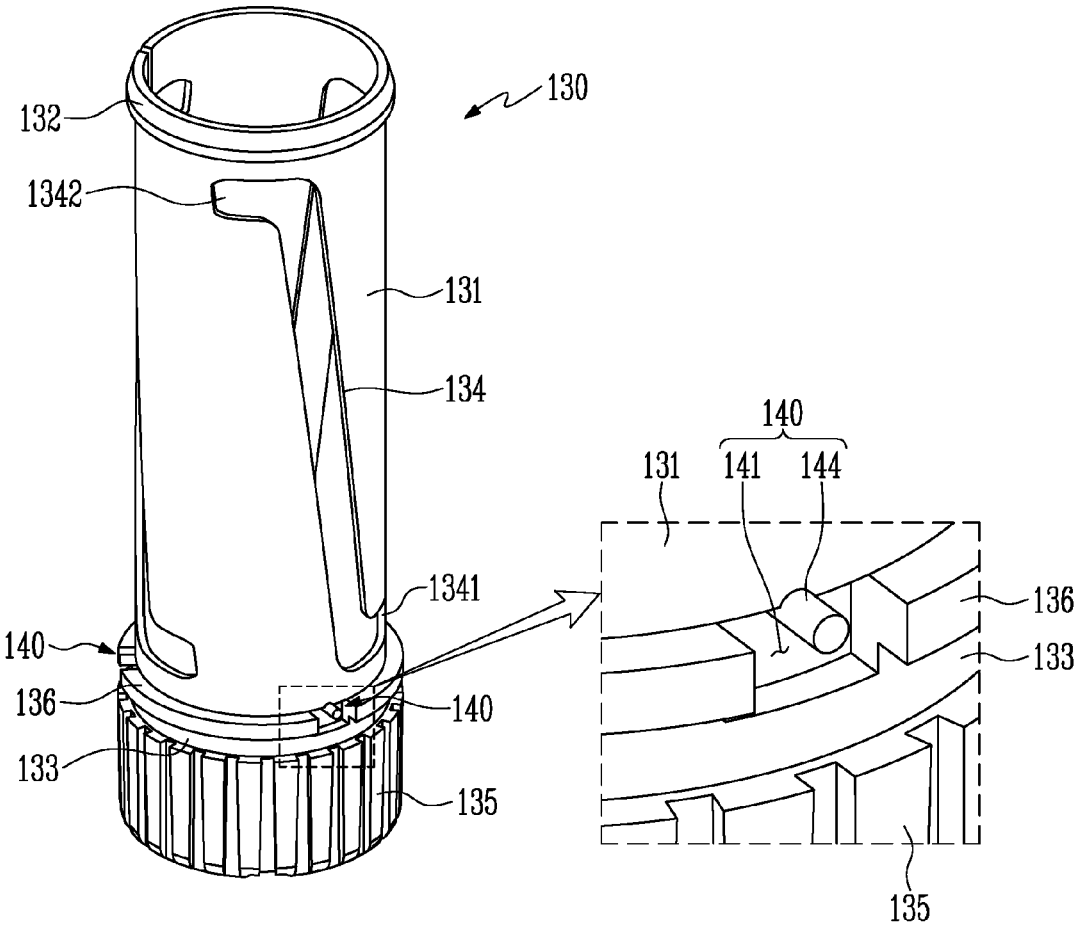
FIG. 3 is a diagram illustrating a second embodiment of the anti-rolling member of FIG. 1.

FIG. 3 is a diagram illustrating a second embodiment of the anti-rolling member of FIG. 1.

In the present embodiment, a plurality of the anti-rolling members 140 may be formed in the area where the ring shaped flange plate 136 provided between the body 131 and the lower edge 133 of the frame 130 is formed, and may include the through hole 141, and a buffer protrusion 144.

A plurality of the through holes 141 may be formed so that the inside and outside of the frame 130 pass through portions of the ring shaped flange plate 136 at regular intervals. The through hole 141 may be formed in a size that the buffer protrusion 144 may be accommodated, and the upper surface may be formed to be on the same line as the upper surface of the flange plate 136. The upper surface of the through hole 141 may be the lower end of the body 131 of the frame 130.

The buffer protrusion 144 may be formed inside the through hole 141. In the buffer protrusion 144, a portion of which is fixed to the lower surface of the body 131 of the frame 130, and the portion protruding outward may be formed to protrude by a predetermined height from the upper surface of the flange plate 136 so as to be in contact with the lower end of the guard ring 120, and may preferably have a height corresponding to the injection molding deviation value.

The buffer protrusion 144 may be in a cylindrical protrusion shape having a small diameter so as to have elastic force by external force while minimizing the surface contact portion with the lower end of the guard ring 120 during rotation of the frame 130.

The anti-rolling member 140 of the present embodiment configured as described above may absorb the injection molding deviation while zeroing the clearance (tolerance) between the lower end of the guard ring 120 and the flange plate 136 by the buffer protrusion 144 in contact with the lower end of the guard ring 120 and having elastic force by external force, thereby preventing the guard ring 120 from shaking when rotating the frame 130 for lifting and lowering of the lifting and lowering part 110.

Figure 4:
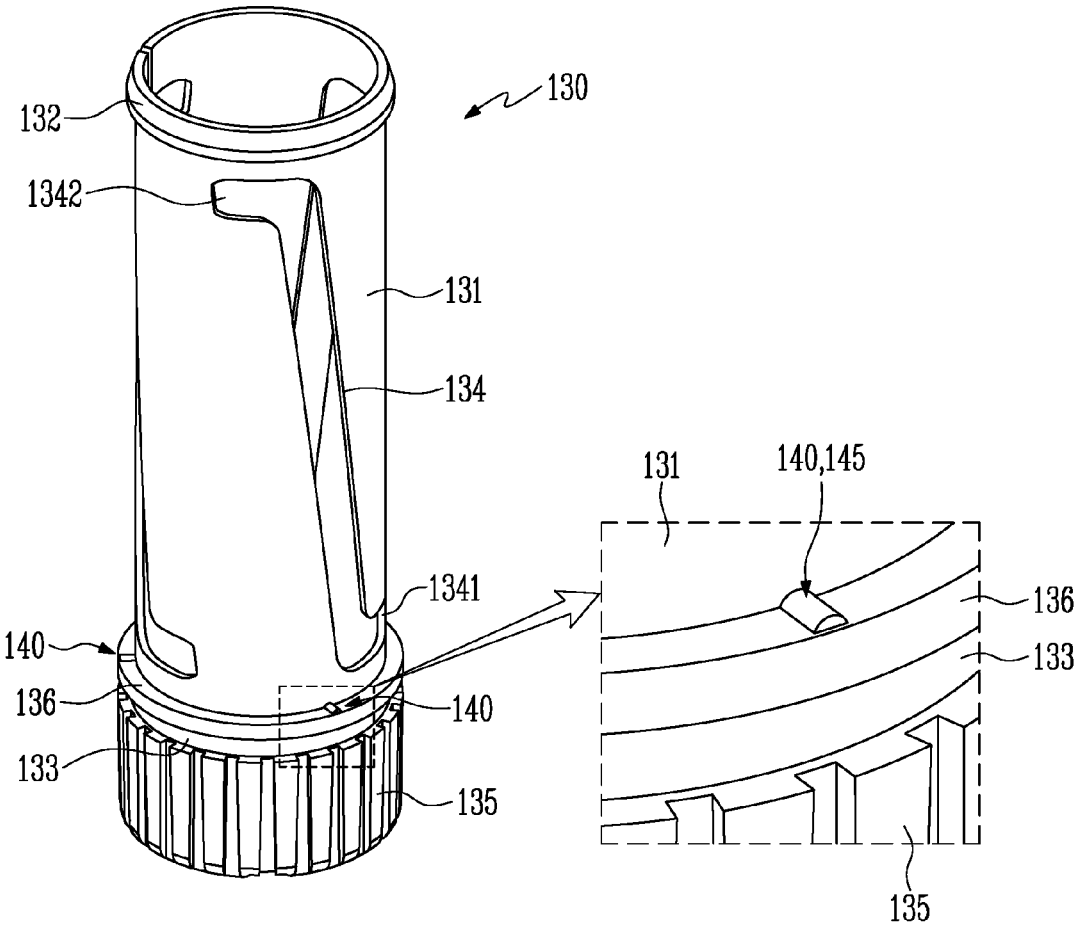
FIG. 4 is a diagram illustrating a third embodiment of the anti-rolling member of FIG. 1.

FIG. 4 is a diagram illustrating a third embodiment of the anti-rolling member of FIG. 1.

The anti-rolling member 140 of the present embodiment may include a plurality of wrinkle protrusions 145 formed on the upper surface of the ring shaped flange plate 136 provided between the body 131 and the lower edge 133 of the frame 130.

The plurality of wrinkle protrusions 145 may be formed to protrude by a predetermined height from the upper surface of the flange plate 136 so as to be in contact with the lower end of the guard ring 120, and may preferably have a height corresponding to the injection molding deviation value.

The wrinkle protrusion 145 may be configured to be in point contact with the lower end of the guard ring 120 when the frame 130 is rotated although it does not have elastic force.

The anti-rolling member 140 of the present embodiment configured as described above may absorb the injection molding deviation while zeroing the clearance (tolerance) between the lower end of the guard ring 120 and the flange plate 136 by the wrinkle protrusion 145 in point-contact with the lower end of the guard ring 120, thereby preventing the guard ring 120 from shaking when rotating the frame 130 for lifting and lowering of the lifting and lowering part 110.

Figure 5:
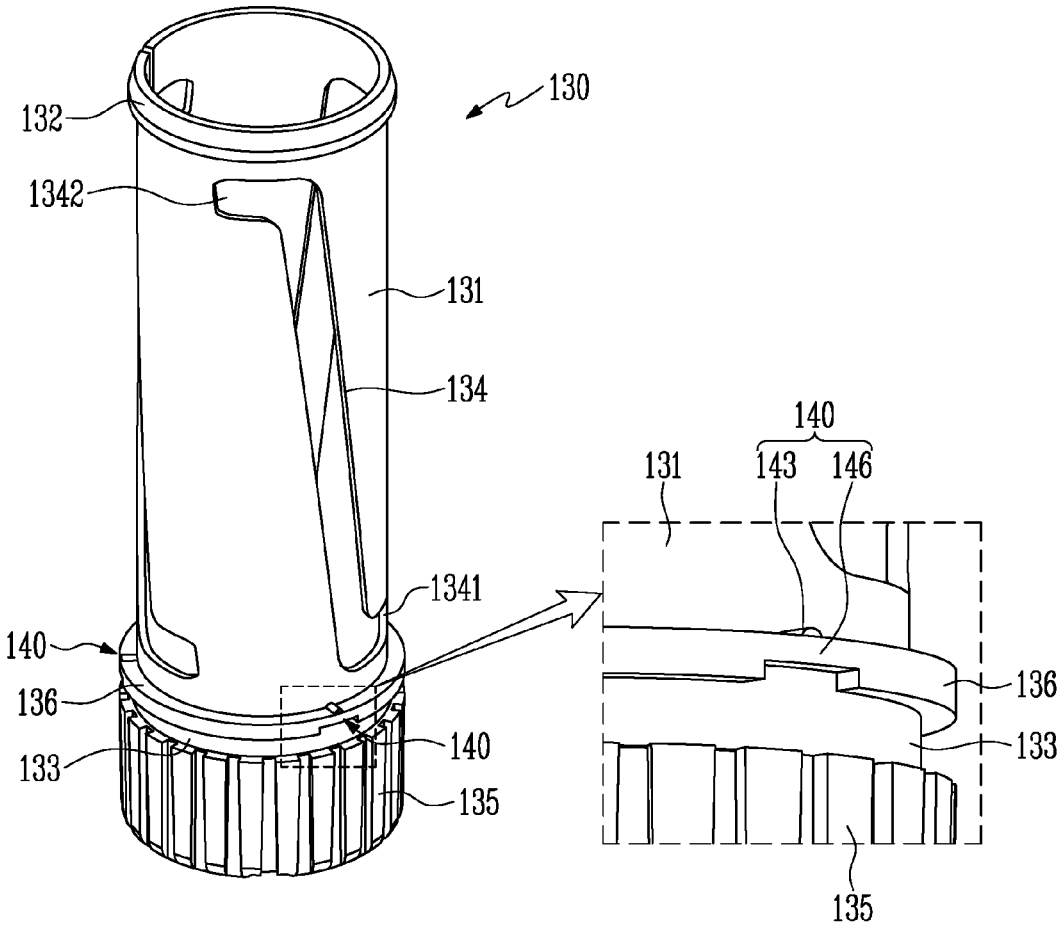
FIG. 5 is a diagram illustrating a fourth embodiment of the anti-rolling member of FIG. 1.

FIG. 5 is a diagram illustrating a fourth embodiment of the anti-rolling member of FIG. 1.

In the present embodiment, a plurality of the anti-rolling members 140 may be formed in the area where the ring shaped flange plate 136 provided between the body 131 and the lower edge 133 of the frame 130 is formed, and may include the contact part 143, and a buffer bridge 146.

A plurality of the buffer bridges 146 may be formed, in a state where portions of the ring shaped flange plate 136 are cut at regular intervals, to connect the flange plate 136 of the cut out portions, may be formed thinner than the thickness of the flange plate 136 so as to have elastic force by external force, and may be in a thin film shape according to an embodiment. In the buffer bridge 146, the upper surface may be formed to be on the same line as the upper surface of the flange plate 136.

The contact part 143 may be formed on the upper surface of the buffer bridge 146. The contact part 143 is a member in contact with the lower end of the guard ring 120, it may be formed to protrude by a predetermined height from the upper surface of the flange plate 136, and may preferably have a height corresponding to the injection molding deviation value. The contact part 143 may have a curved shape to minimize the surface contact portion with the lower end of the guard ring 120 when the frame 130 is rotated.

The anti-rolling member 140 of the present embodiment configured as described above may absorb the injection molding deviation while zeroing the clearance (tolerance) between the lower end of the guard ring 120 and the flange plate 136 by the contact part 143 in contact with the lower end of the guard ring 120 and the buffer bridge 146 having elastic force by external force transmitted by the contact part 143, thereby preventing the guard ring 120 from shaking when rotating the frame 130 for lifting and lowering of the lifting and lowering part 110.

Figure 6:
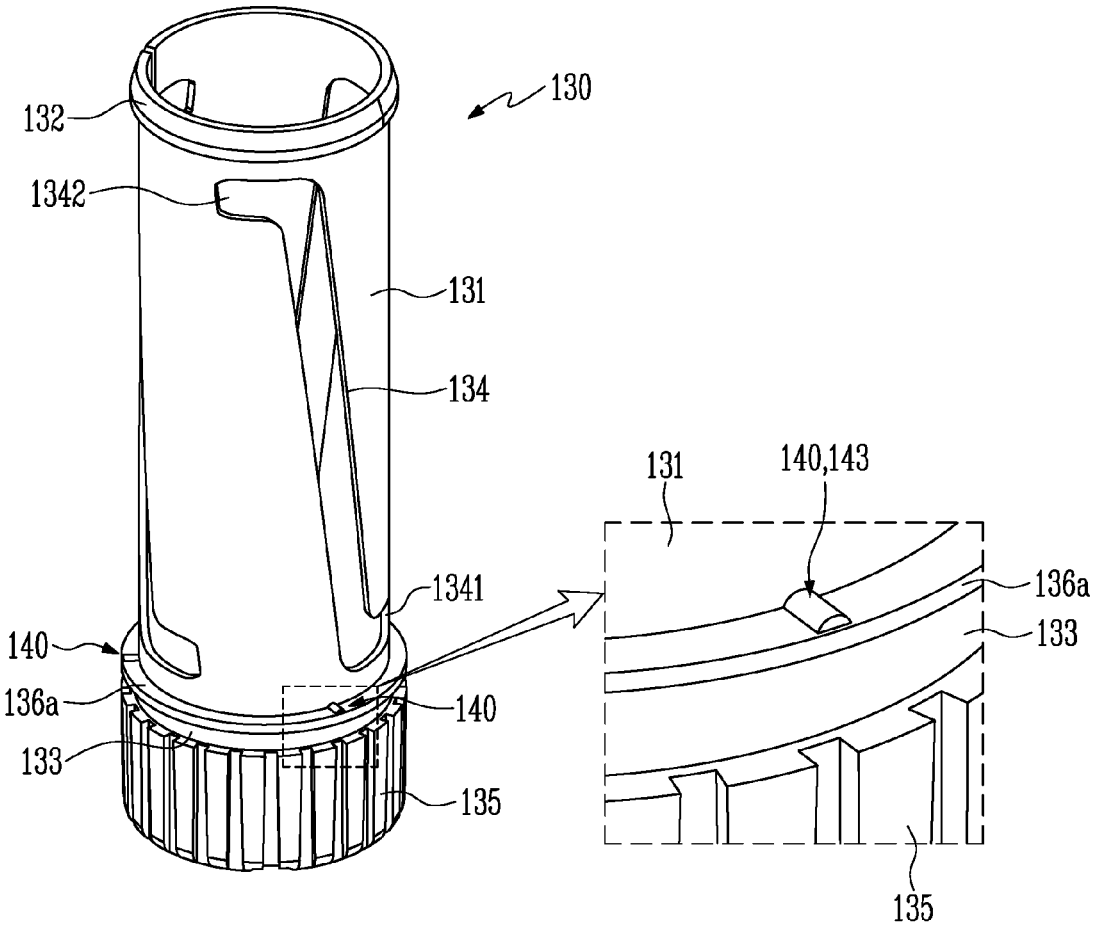
FIG. 6 is a diagram illustrating a fifth embodiment of the anti-rolling member of FIG. 1.

FIG. 6 is a diagram illustrating a fifth embodiment of the anti-rolling member of FIG. 1.

The anti-rolling member 140 of the present embodiment may include a deformed flange plate 136*a* provided between the body 131 and the lower edge 133 of the frame 130 and formed in a thin film shape so as to have elastic force by external force, and a plurality of the contact parts 143 formed at regular intervals on the upper surface of the deformed flange plate 136*a*.

If the flange plate 136 of another embodiment of the present disclosure has rigidity by increasing the thickness, the modified flange plate 136*a* of the embodiment of the present disclosure may be different in that it has flexibility by thinning the thickness. Of course, the deformed flange plate 136*a* of the embodiment of the present disclosure may be formed of a material to have rigidity even if the thickness is thin.

The contact part 143 may be formed on the upper surface of the deformed flange plate 136*a*. The contact part 143 is a member in contact with the lower end of the guard ring 120, it may be formed to protrude by a predetermined height from the upper surface of the deformed flange plate 136*a*, and may preferably have a height corresponding to the injection molding deviation value. The contact part 143 may have a curved shape to minimize the surface contact portion with the lower end of the guard ring 120 when the frame 130 is rotated.

The anti-rolling member 140 of the present embodiment configured as described above may absorb the injection molding deviation while zeroing the clearance (tolerance) between the lower end of the guard ring 120 and the flange plate 136 by the contact part 143 in contact with the lower end of the guard ring 120 and the deformed flange plate 136*a* having elastic force by external force transmitted by the contact part 143, thereby preventing the guard ring 120 from shaking when rotating the frame 130 for lifting and lowering of the lifting and lowering part 110.

Figure 7:
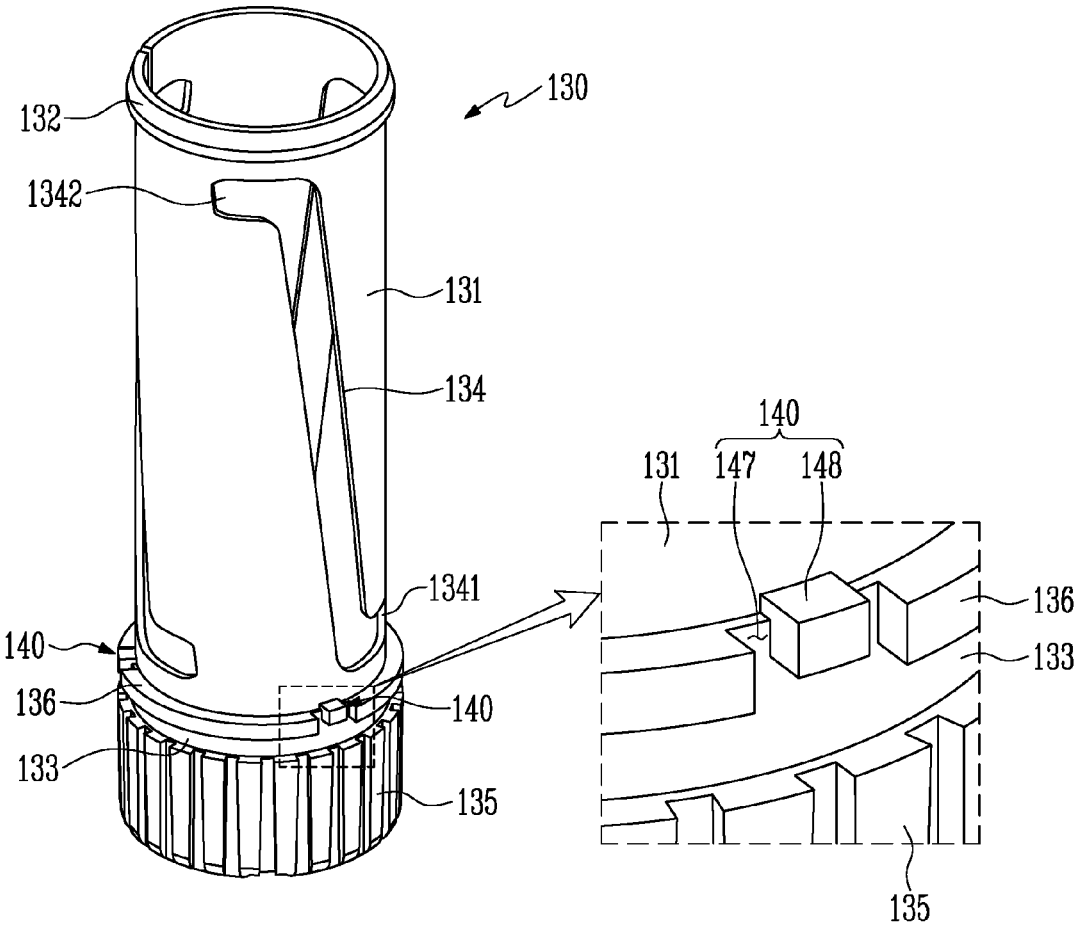
FIG. 7 is a diagram illustrating a sixth embodiment of the anti-rolling member of FIG. 1.

FIG. 7 is a diagram illustrating a sixth embodiment of the anti-rolling member of FIG. 1.

In the present embodiment, a plurality of the anti-rolling members 140 may be formed in the area where the ring shaped flange plate 136 provided between the body 131 and the lower edge 133 of the frame 130 is formed, and may include an cutting groove 147, and a buffer protrusion 148.

A plurality of the cutting grooves 147 may be formed by cutting portions of the ring shaped flange plate 136 at regular intervals. The cutting groove 147 may be formed in a size that may accommodate the buffer protrusion 148.

The buffer protrusion 148 may be formed inside the cutting groove 147. In the buffer protrusion 148, a portion having a predetermined height, for example, a portion having a height corresponding to the injection molding deviation value from the upper surface of the flange plate 136 is fixed to a lower side surface of the body 131 of the frame 130 and protrudes outward so as to be in contact with the lower end of the guard ring 120, and a portion located in the cutting groove 147 may extend directly downward.

In the buffer protrusion 148, a portion in contact with the lower end of the guard ring 120 may be a rectangle.

The anti-rolling member 140 of the present embodiment configured as described above may absorb the injection molding deviation while zeroing the clearance (tolerance) between the lower end of the guard ring 120 and the flange plate 136 by the buffer protrusion 148 in contact with the lower end of the guard ring 120 and having elastic force by external force, thereby preventing the guard ring 120 from shaking when rotating the frame 130 for lifting and lowering of the lifting and lowering part 110.

Figure 8:
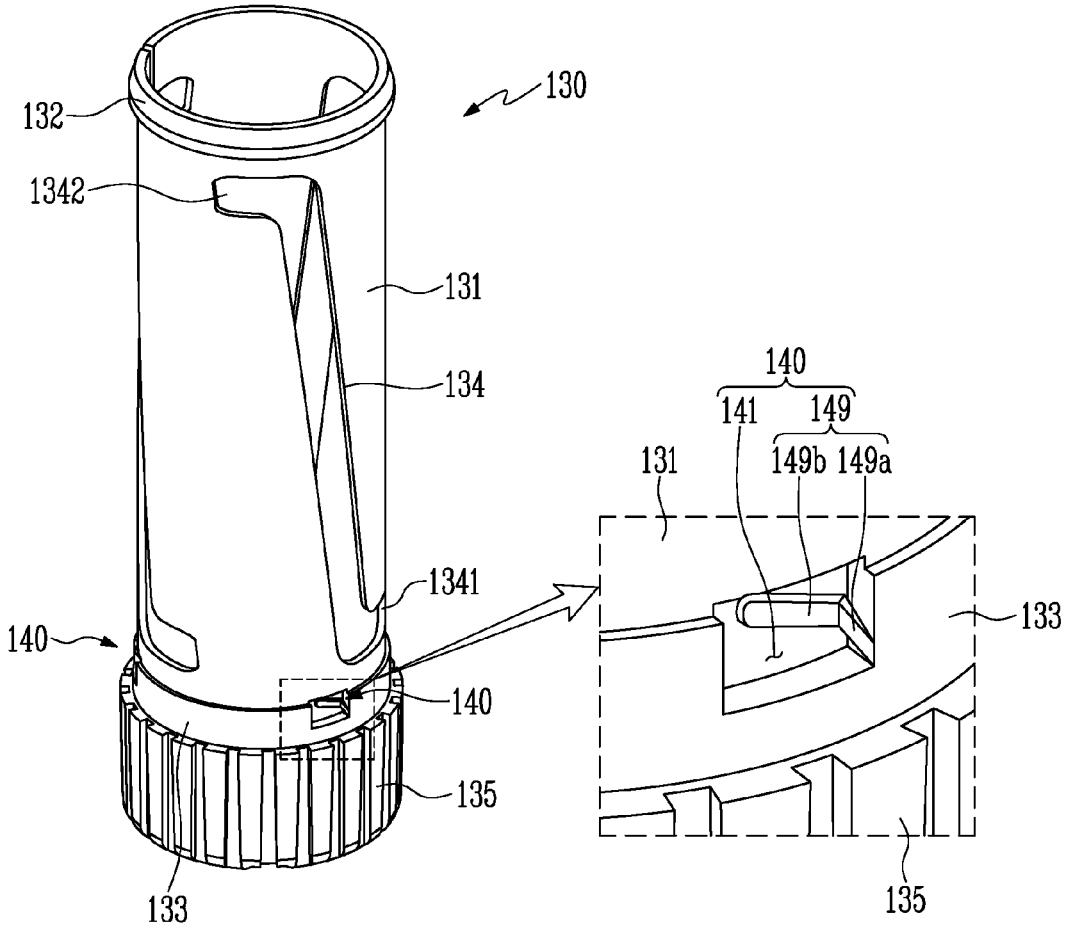
FIG. 8 is a diagram illustrating a seventh embodiment of the anti-rolling member of FIG. 1.

FIG. 8 is a diagram illustrating a seventh embodiment of the anti-rolling member of FIG. 1.

According to the present embodiment, the ring shaped flange plate 136 provided in other embodiments for seating the guard ring 120 between the body 131 and the lower edge 133 of the frame 130 is omitted, the lower edge 133 extends to the area where the omitted flange plate 136 is formed, and a plurality of the anti-rolling members 140 may be formed at portions of the extended lower edge 133, in other words, the area where the flange plate 136 of other embodiments is formed and may include the through hole 141 and a buffer bar 149.

Here, the lower edge 133 of the frame 130 has an outer diameter larger than the outer diameter of the body 131 of the frame 130 as described above, and the extended lower edge 133 portion may also be formed in a step shape having a larger outer diameter than the outer diameter of the body 131.

A plurality of the through holes 141 may be formed so that the inside and outside of the frame 130 pass through portions of the area where the flange plate 136 of other embodiments from which the lower edge 133 extends at regular intervals. The through hole 141 may be formed in a size that the buffer bar 149 may be accommodated, and the upper surface may be formed to be on the same line as the extending upper surface of the lower edge 133. The upper surface of the through hole 141 may be the lower end of the body 131 of the frame 130.

The buffer bar 149 may be formed inside the through hole 141. The buffer bar 149 may have elastic force by external force while minimizing the surface contact portion with the lower end of the guard ring 120 when the frame 130 rotates, and may include a fixing bar 149*a* and a flexible bar 149*b*.

The fixing bar 149*a* may be fixed to one side surface of the through hole 141. The fixing bar 149*a* may be extended inward from an outside of one side surface of the through hole 141, and be fixed to one side surface of the through hole 141 so as to have predetermined inclination upward. The reason why the fixing bar 149*a* has the predetermined inclination upward is to allow the end of the flexible bar 149*b* to easily protrude upward than the upper surface of the extended lower edge 133.

The flexible bar 149*b* may be connected to one side of the fixed bar 149*a*. The flexible bar 149*b* is extended outward with a predetermined inclination upward from the inside of the through hole 141, and may extend to have a height corresponding to the injection molding deviation value while protruding outward than the outer circumferential surface of the lower edge 133 in consideration of the injection molding deviation value of the flange plate 136 in which the lower end of the guard ring 120 is in contact with the end and provided in another embodiment. In other words, the flexible bar 149*b* may be formed so that the end is located higher than the upper surface of the lower edge 133 while protruding outward than the outer circumferential surface of the lower edge 133.

The buffer bar 149 may be formed in a '¬' shape in the through hole 141 by the fixing bar 149*a* and the flexible bar 149*b*.

The anti-rolling member 140 of the present embodiment configured as described above may absorb the injection molding deviation while zeroing the clearance (tolerance) between the lower end of the guard ring 120 and the flange plate 136 by the buffer bar 144 in contact with the lower end of the guard ring 120 and having elastic force by external force, thereby preventing the guard ring 120 from shaking when rotating the frame 130 for lifting and lowering of the lifting and lowering part 110.

Figure 9:
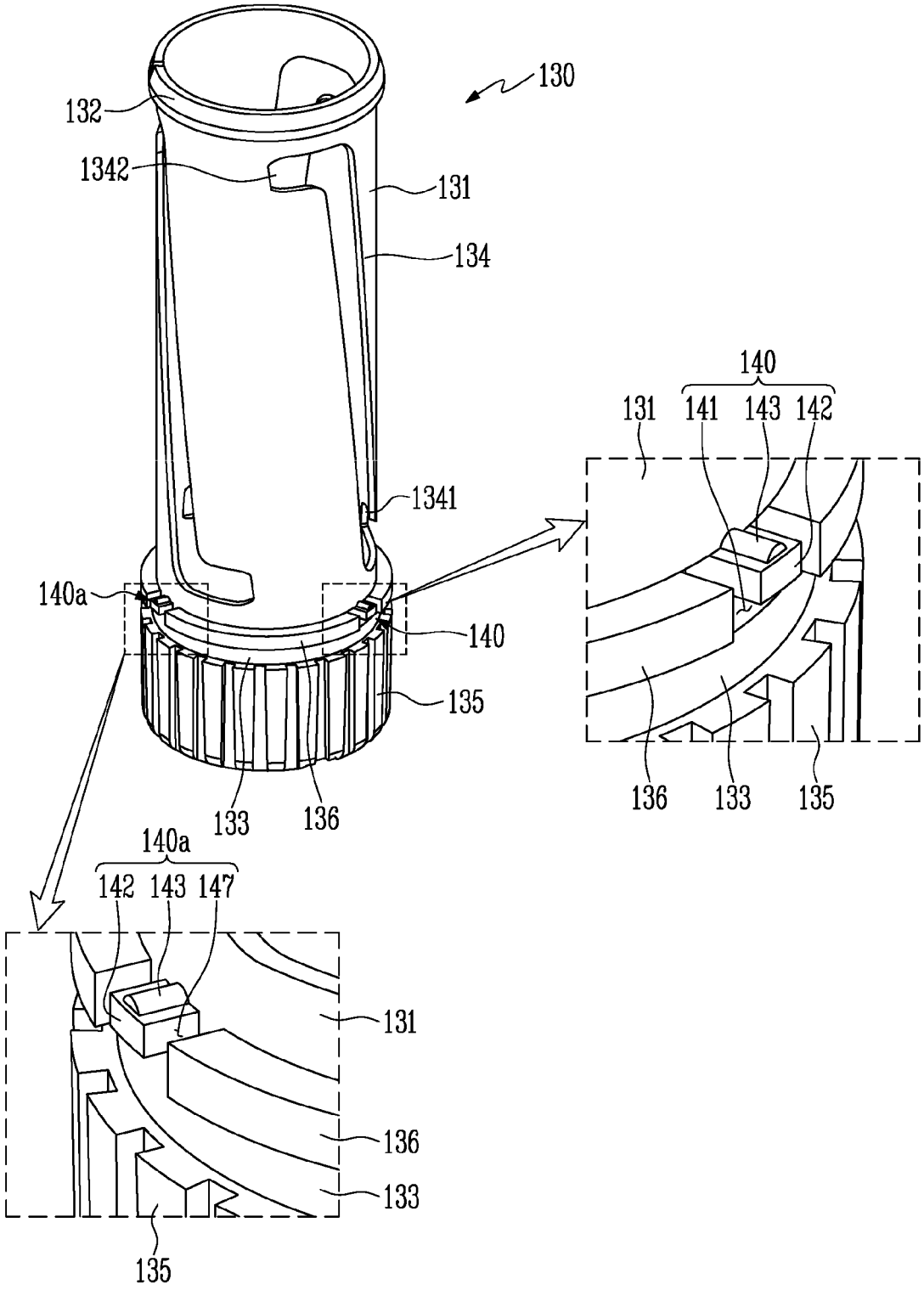
FIG. 9 is a diagram illustrating an eighth embodiment of the anti-rolling member of FIG. 1.

FIG. 9 is a diagram illustrating an eighth embodiment of the anti-rolling member of FIG. 1.

In the present embodiment, a plurality of anti-rolling members 140 and 140*a* may be formed in the area where the ring shaped flange plate 136 provided between the body 131 and the lower edge 133 of the frame 130 is formed, and may include the through hole 141, the cutting groove 147, the buffer platform 142, and the contact part 143.

The plurality of anti-rolling members 140 and 140*a* of the embodiment may include at least one of the anti-rolling members 140 according to the first embodiment including the through-hole 141, the buffer platform 142, and the contact part 143 described with reference to FIG. 2, and a deformed anti-rolling member 140*a* in which the contact part 143 is formed on the upper surface of the buffer platform 142 described with reference to FIG. 2 in the cutting groove 147 described with reference to FIG. 7.

Here, since any one of the anti-rolling members 140 of the embodiment is the same as or similar to the anti-rolling member 140 of the first embodiment, a detailed description will be omitted to avoid duplicate descriptions.

In addition, the deformed anti-rolling member 140*a* of the embodiment of the present disclosure is different from the anti-rolling member 140 of the first embodiment in that it is formed in the cutting groove 147, but has the same or similar configuration, so a detailed description will be omitted herein in order to avoid duplicate description.

The plurality of anti-rolling members 140 according to the first to eighth embodiments described with reference to FIG. 2 to FIG. 9 may be disposed in various ways, such as at regular intervals or at different angles. For example, when there are three anti-rolling members 140, they may be disposed at an angle of 120 degrees at regular intervals, or may be disposed at different angles in the order of 140 degrees, 120 degrees, and 100 degrees.

The present disclosure is not limited to the first to eighth embodiments of the anti-rolling member 140 described above, and may include a combination of the above embodiments or a combination of at least any one of the embodiments and a related art as another embodiment.

Although the present disclosure has been described in detail through specific examples, this is for the purpose of describing the present disclosure in detail, and the present disclosure is not limited thereto. It will be apparent that modifications or improvements are possible by those of ordinary skill in the art within the technical spirit of the present disclosure. All simple modifications or changes of the present disclosure fall within the scope of the present disclosure, and the specific protection scope of the present disclosure will become apparent by the appended claims.

DESCRIPTION OF SYMBOLS

100: Cosmetic container 110: Lifting and lowering part
111: Body 112: Guide protrusion
120: Guard ring 121: Body
122: Spiral groove 123: End ring
130: Frame 131: Body
132: Upper edge 133: Lower edge
134: Guide hole 1341: Lower fixing part
1342: Upper fixing part 135: handle
136, 136*a*: Flange plate 140: Anti-rolling member
141: Through hole 142: Buffer platform
143: Contact part 144, 148: Buffer protrusion
145: Wrinkle protrusion 146: Buffer bridge
147: Cutting groove 149: Buffer bar
149*a*: Fixing bar 149*b*: Flexible bar

The invention claimed is:

1. A cosmetic container comprising:

a lifting and lowering part configured to accommodate a cosmetic and having a guide protrusion disposed on an outside thereof;

a guard ring having a spiral groove which is coupled to the guide protrusion and formed on an inner circumferential surface thereof; and a frame comprising a body coupled to an inside of the guard ring and in which a guide hole through which the guide protrusion of the lifting and lowering part passes is formed, a lower edge provided in a lower portion of the body, and a flange plate provided between the body and the lower edge to allow a lower end of the guard ring to be seated thereon, wherein the cosmetic container further comprises a plurality of anti-rolling members provided in an area where the flange plate is formed so as to support the lower end of the guard ring to prevent shaking of the guard ring when the guard ring is rotated by rotation of the frame in order to lift and lower the lifting and lowering part, wherein the plurality of anti-rolling members comprise a space formed by cutting portions of the flange plate at regular intervals and a buffer member formed inside the space, and wherein an upper surface of the buffer member is in contact with the lower end of the guard ring.

2. The cosmetic container of claim 1, wherein the space comprises:

through holes formed in a portion of the flange plate at regular intervals and through which an inside and an outside of the frame pass, upper surfaces of the through holes lying on a same line as an upper surface of the flange plate; and wherein the buffer member comprises:

a buffer platform formed inside the through hole and having elastic force by external force, an upper surface of the buffer platform being fixed to a lower surface of the body; and a contact part formed in a curved shape on the upper surface of the buffer platform and protruding by a predetermined height from the upper surface of the flange plate so as to contact with the lower end of the guard ring.

3. The cosmetic container of claim 1, wherein the space comprises:

through holes formed in a portion of the flange plate at regular intervals and through which an inside and an outside of the frame pass, upper surfaces of the through holes lying on a same line as an upper surface of the flange plate; and wherein the buffer member comprises a buffer protrusion formed in the form of a cylindrical protrusion inside the through hole, a portion of which is fixed to a lower surface of the body, wherein the buffer protrusion protrudes from the upper surface of the flange plate by a predetermined height so that a part of the buffer protrusion protruding outward is in contact with the lower end of the guard ring and has elastic force.

4. The cosmetic container of claim 1, wherein the buffer member comprises wrinkle protrusions formed on an upper surface of the flange plate to point-contact with the lower end of the guard ring.

5. The cosmetic container of claim 1, wherein the buffer member comprises:

buffer bridges formed to, in a state where portions of the flange plate are cut at regular intervals, connect the flange plate of the cut out portions and formed thinner than a thickness of the flange plate so as to have elastic force by external force, upper surfaces of the buffer bridges lying on a same line as an upper surface of the flange plate; and a contact part formed in a curved shape on an upper surface of the buffer bridge and protruding by a predetermined height from the upper surface of the flange plate so as to contact with the lower end of the guard ring.

6. The cosmetic container of claim 1, wherein the flange plate is a deformed flange plate formed in the form of a thin film to have elastic force by external force, and wherein the buffer member comprises a contact part formed in a curved shape on an upper surface of the deformed flange plate and protruding by a predetermined height from the upper surface of the flange plate so as to contact with the lower end of the guard ring.

7. The cosmetic container of claim 1, wherein the space comprises cutting grooves formed by cutting portions of the flange plate at regular intervals, wherein the buffer member comprises a buffer protrusion formed inside the cutting groove, and wherein a part of the buffer protrusion having a predetermined height from an upper surface of the flange plate is fixed to a lower side surface of the body and protrudes outward so as to be in contact with the lower end of the guard ring, a part of the buffer protrusion located in the cutting groove extends directly downward, a part of the buffer protrusion in contact with the lower end of the guard ring is a rectangle, and the buffer protrusion has elastic force.

8. The cosmetic container of claim 1, wherein the flange plate is omitted in the frame, wherein the lower edge is formed to extend to an area of the omitted flange plate, and wherein the plurality of anti-rolling members comprise:

through holes formed in portions of the extended lower edge at regular intervals through with an inside and an outside of the frame pass, upper surfaces of the through holes lying on a same line as an upper surface of the extended lower edge; and a buffer bar formed in a '¬' shape inside the through hole, wherein a part of the buffer bar protruding outward is formed higher than the upper surface of the extended lower edge so as to be in contact with the lower end of the guard ring and the buffer bar has elastic force.

9. The cosmetic container of claim 8, wherein the buffer bar comprises:

a fixing bar extending inward from an outside of one side surface of the through hole and fixed to one side surface of the through hole so as to have a predetermined inclination upward; and a flexible bar connected to one side of the fixing bar and extending outward with a predetermined inclination upward from an inside of the through hole, wherein an end of the flexible bar protrudes outward from an outer peripheral surface of the extended lower edge and extends higher than an upper surface of the extended lower edge so as to be in contact with the lower end of the guard ring, and the flexible bar has elastic force.

* * * * *